US008310215B2

(12) United States Patent
Chou et al.

(10) Patent No.: US 8,310,215 B2
(45) Date of Patent: Nov. 13, 2012

(54) LINEAR MODULATION VOLTAGE TRANSFORMER CIRCUITRY

(75) Inventors: Chen-Kun Chou, Taoyuan (TW); Zhan-Yi Lin, Taoyuan (TW); Ting-Kuan Li, Taoyuan (TW); Yu-Jen Chen, Taoyuan (TW); Chi-Bin Wu, Taoyuan (TW)

(73) Assignee: Chung-Hsin Electric and Machinery Manufacturing Corp., Taipei (TW)

( * ) Notice: Subject to any disclaimer, the term of this patent is extended or adjusted under 35 U.S.C. 154(b) by 434 days.

(21) Appl. No.: 12/777,437

(22) Filed: May 11, 2010

(65) Prior Publication Data

US 2011/0156665 A1 Jun. 30, 2011

(30) Foreign Application Priority Data

Dec. 31, 2009 (TW) ..... 98146158 A

(51) Int. Cl.
*G05F 1/70* (2006.01)

(52) U.S. Cl. ..... 323/222; 323/224; 363/63

(58) Field of Classification Search ..... 323/222, 323/224, 282–288, 351, 290; 363/49, 55, 363/63, 65, 71, 76
See application file for complete search history.

(56) References Cited

U.S. PATENT DOCUMENTS

| | | | | |
|---|---|---|---|---|
| 4,347,474 | A * | 8/1982 | Brooks et al. | 323/224 |
| 5,471,131 | A * | 11/1995 | King et al. | 323/314 |
| 6,181,120 | B1 * | 1/2001 | Hawkes et al. | 323/282 |
| 6,774,612 | B1 * | 8/2004 | Ballenger et al. | 323/303 |
| 7,724,546 | B2 * | 5/2010 | Kusubayashi | 363/21.01 |

* cited by examiner

*Primary Examiner* — Rajnikant Patel
(74) *Attorney, Agent, or Firm* — Stites & Harbison, PLLC; Juan Carlos A. Marquez, Esq

(57) ABSTRACT

A linear modulation voltage transformer circuitry includes a power stage unit, a voltage division unit, a linear modulation unit, an error amplifier, and a recursive controller. The power stage unit adapts an input voltage and outputs a first voltage to the voltage division unit, which outputs a divided voltage. The linear modulation unit receives the divided voltage, compares it with a control voltage, and outputs an error voltage signal to the error amplifier, which amplifies the error voltage signal as an error gain control signal. The recursive controller receives and modulates the error gain control signal and outputs the modulation error gain control signal to the power stage unit as a reference signal so as for the power stage unit to modulate the first voltage. Thus, the first voltage can be varied in real time via the linear modulation unit to meet load demands.

8 Claims, 5 Drawing Sheets

LINEAR MODULATION VOLTAGE TRANSFORMER CIRCUITRY

BACKGROUND OF THE INVENTION

1. Technical Field

The present invention relates to a linear modulation voltage transformer circuitry and, more particularly, to a linear modulation voltage transformer configured for real-time voltage transformation.

2. Description of Related Art

Voltage transformers serve to convert an input power, such as an input current, into an output power of a certain specification, such as a specific output voltage. For example, a common analog voltage transformer typically uses two voltage divider resistors to step down an input voltage to a specific or a predetermined voltage.

Please refer to FIG. 1 for the circuitry of a conventional voltage transformer and to FIG. 2 for a block diagram of the conventional voltage transformer.

As shown in FIG. 1, the circuitry of a conventional voltage transformer 10 includes a power stage unit 30, a voltage division unit 40, an error amplifier 50, and a recursive controller 60, wherein the output end of the recursive controller 60 connects to the power stage unit 30.

The power stage unit 30 is configured for step-up, step-down, and step-up/down voltage conversion so as to convert an input voltage 20 into an output voltage of a certain specification.

The voltage division unit 40 is connected to the power stage unit 30 and includes two voltage divider resistors. The voltage division unit 40 can use different voltage divider resistors to divide the input voltage 20 at different ratios according to the voltage specification of a load circuit and then outputs a divided voltage $V_R$ to the error amplifier 50.

The error amplifier 50, which includes a first impedance 51, a second impedance 52, and an amplifier 53, receives the divided voltage $V_R$, compares the divided voltage $V_R$ with a reference voltage $V_{Ref}$, amplifies the voltage difference therebetween, and outputs an error gain control signal EGS to the recursive controller 60. The error gain control signal EGS serves as a basis on which the power stage unit 30 determines whether to perform step-up, step-down, or step-up/down voltage conversion.

The recursive controller 60 is a pulse width modulator 61 for modulating the pulse width of the error gain control signal EGS, generating a gain control signal GCS suitable for the power stage circuit, and outputting the gain control signal GCS to the power stage unit 30. Therein, a check voltage $V_{Mag}$ is a necessary parameter for pulse width modulation of the error gain control signal EGS.

As shown in FIG. 2, the power stage unit 30, the voltage division unit 40, the error amplifier 50, and the recursive controller 60 form a closed-loop circuit that provides stable and continuous feedback so as to output a voltage meeting the load demand of a specific load circuit.

Presently, the conventional voltage transformer 10 is applicable only to load circuits of a certain voltage specification. If it is desired to apply the voltage transformer 10 to load circuits of different voltage specifications, the output voltage of the voltage transformer 10 must be varied.

One common solution to varying the output voltage of the conventional voltage transformer 10 is to use a variable resistor as the voltage division unit 40. However, the disadvantage of using the variable resistor is that the resistance must be manually adjusted, which may result in over-adjustment and subsequent damage to the circuit, and that real-time adjustment is unattainable.

Another common solution is to change the reference voltage $V_{Ref}$ and thereby change the error gain control signal EGS output from the error amplifier 50. Since the reference voltage $V_{Ref}$ of an analog circuit is built-in to the circuit in advance and therefore unchangeable, this solution is applicable only to a digital voltage transformer. However, once the circuit is burned into an IC, all the divided voltages are fixed; hence, it is impossible to change the output voltage by varying the reference voltage $V_{Ref}$.

BRIEF SUMMARY OF THE INVENTION

It is an objective of the present invention to provide a linear modulation voltage transformer circuitry which, due to the provision of a linear modulation unit, is applicable to load circuits of various voltage specifications and capable of real-time adjustment of its output voltage in accordance with the desired voltage specification.

It is another objective of the present invention to provide a linear modulation voltage transformer circuitry which, due to the provision of a linear modulation unit, can generate a linear voltage difference signal in order to output a linearly modulation voltage.

To achieve the above objectives, the present invention provides a linear modulation voltage transformer circuitry which includes: a power stage unit for receiving and adapting an input voltage and outputting a first voltage; a voltage division unit electrically connected to an output end of the power stage unit and configured to receive the first voltage and output a divided voltage; a linear modulation unit for receiving the divided voltage and a control voltage and outputting an error voltage signal; an error amplifier for receiving the error voltage signal as a reference voltage and comparing the divided voltage with the reference voltage so as to generate an error gain control signal; and a recursive controller for receiving the error gain control signal and outputting a gain control signal to the power stage unit so as for the power stage unit to modulate the first voltage.

Implementation of the present invention involves at least the following inventive steps:

1. The linear modulation voltage transformer circuitry with the linear modulation unit features a highly adaptive output voltage and therefore is applicable to load circuits of various voltage specifications.

2. When the load circuit is changed, the linear modulation voltage transformer circuitry with the linear modulation unit can perform step-up, step-down, and step-up/down voltage conversion in keeping with the voltage specification of the load circuit without having to modify the linear modulation voltage transformer circuitry itself, thus broadening the range of load circuits to which the linear modulation voltage transformer circuitry is applicable.

3. The linear modulation unit allows a secondary current converter circuit to be used invariably; in other words, there is no need to change the secondary current converter circuit when the load circuit is changed.

BRIEF DESCRIPTION OF THE SEVERAL VIEWS OF THE DRAWINGS

A detailed description of further features and advantages of the present invention is given below so that a person skilled in the art can understand and implement the technical contents of the present invention and readily comprehend the objectives and advantages thereof by reference to the disclosure of the present specification and the appended claims in conjunction with the accompanying drawings, in which:

DETAILED DESCRIPTION OF THE INVENTION

Figure 1:
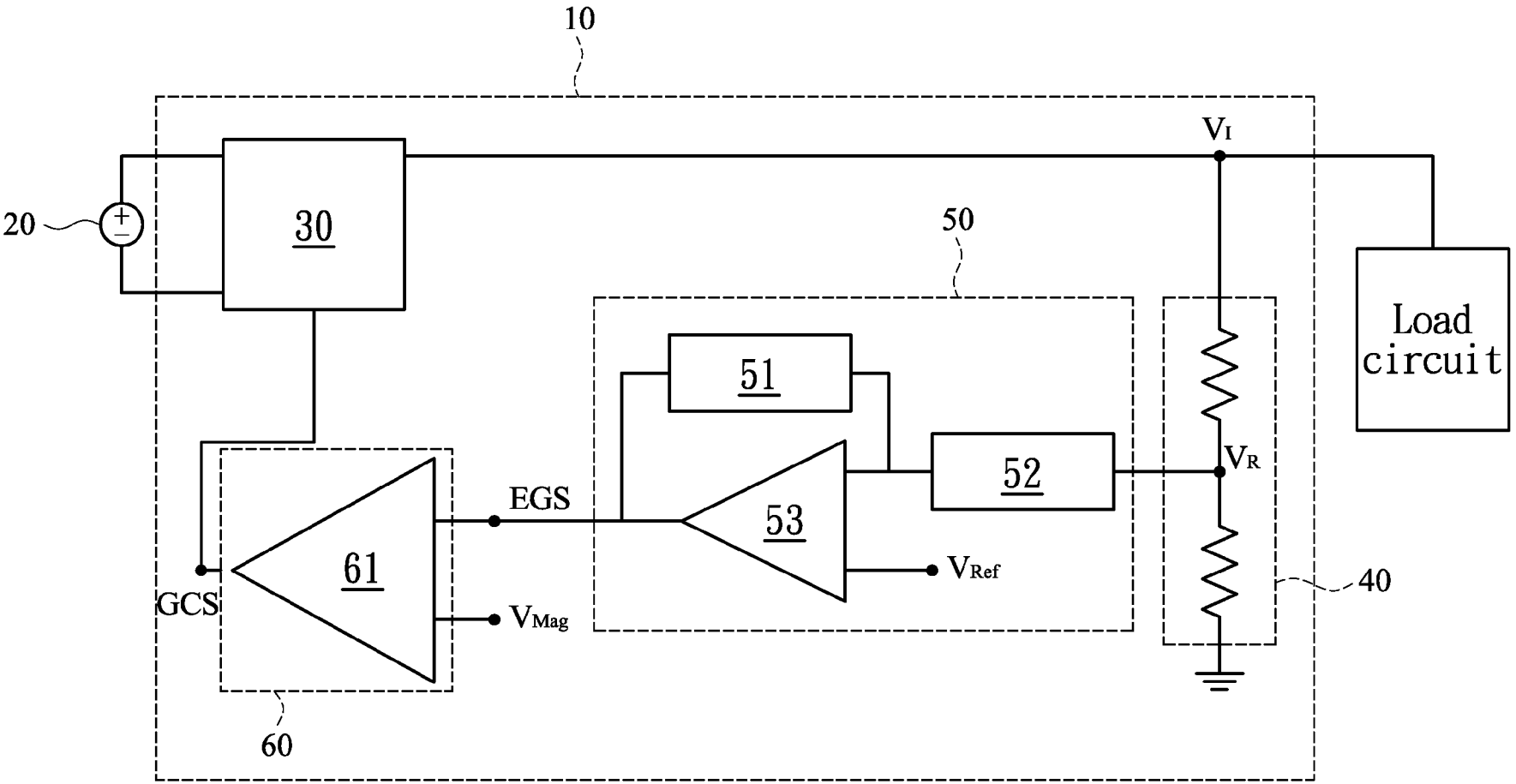
FIG. 1 (PRIOR ART)
FIG. 1 shows the circuitry of a conventional voltage transformer.
Figure 2:
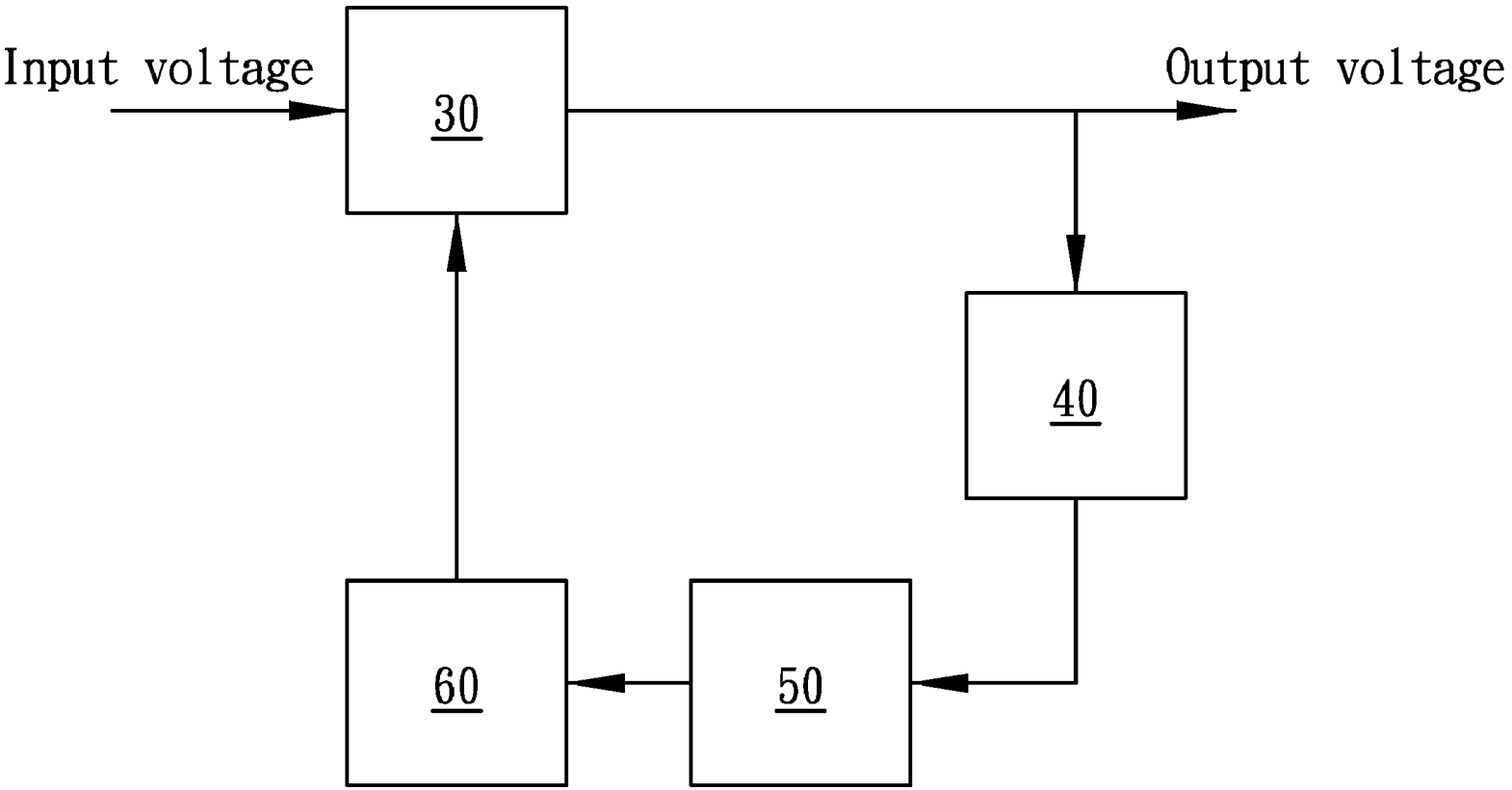
FIG. 2 (PRIOR ART)
FIG. 2 is a block diagram of the conventional voltage transformer.
Figure 3:
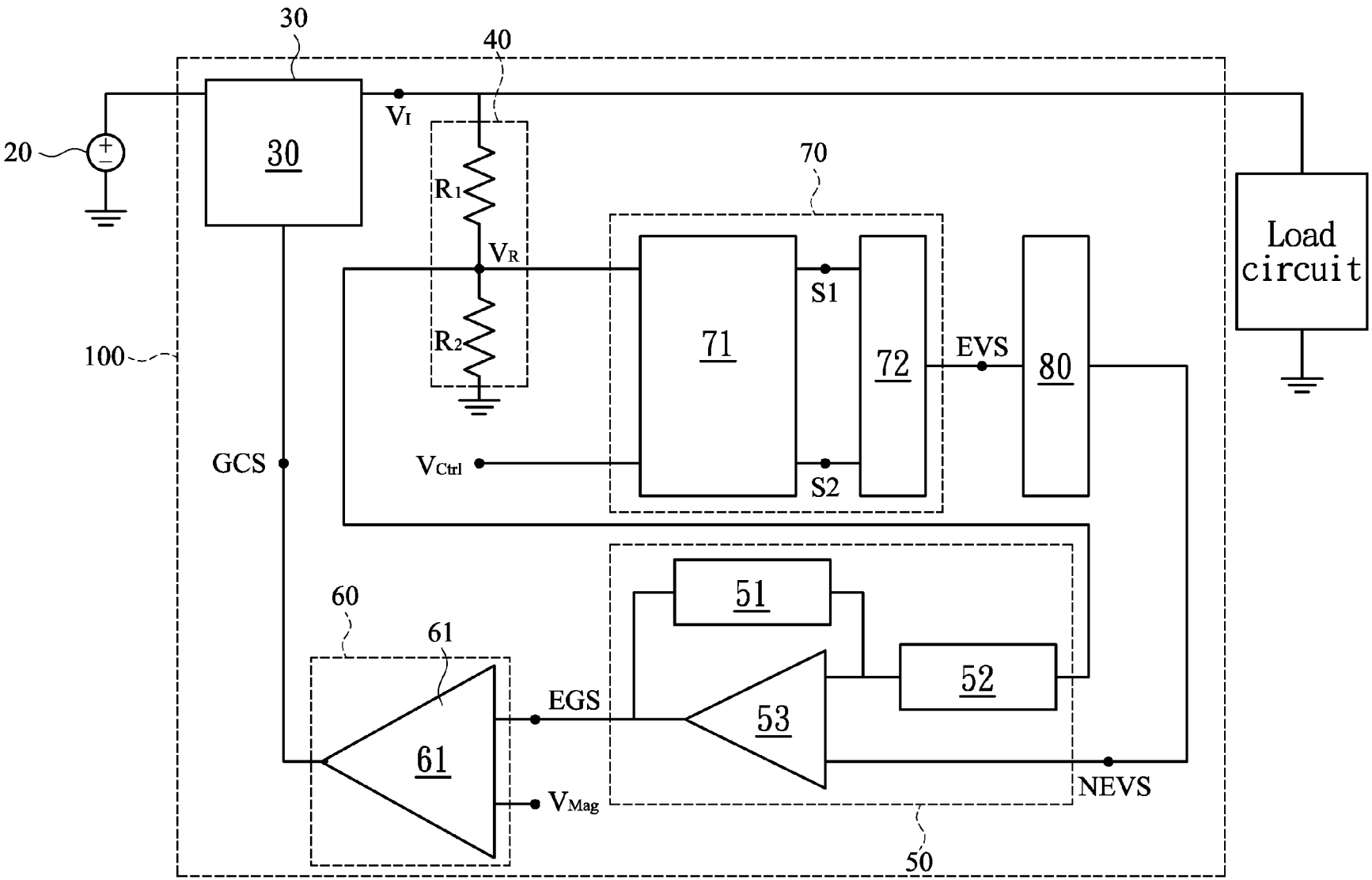
FIG. 3 shows a linear modulation voltage transformer circuitry according to an embodiment of the present invention.

Referring to FIG. 3, a linear modulation voltage transformer circuitry 100 according to an embodiment of the present invention includes a power stage unit 30, a voltage division unit 40, a linear modulation unit 70, an error amplifier 50, and a recursive controller 60.

The power stage unit 30 receives an input voltage 20, adapts the received input voltage 20, and outputs a first voltage $V_1$. The power stage unit 30 is capable of step-up, step-down, and step-up/down voltage conversion.

The voltage division unit 40, which is electrically connected to an output end of the power stage unit 30, receives the first voltage $V_1$ and outputs a divided voltage $V_R$. The voltage division unit 40 includes two voltage divider resistors, namely a first resistor $R_1$ and a second resistor $R_2$. The first resistor $R_1$ and the second resistor $R_2$ are connected in series between the output end of the power stage unit 30 and a ground end. A divided voltage output end for outputting the divided voltage $V_R$ is the node between the first resistor $R_1$ and a second resistor $R_2$.

The linear modulation unit 70 receives the divided voltage $V_R$ and a control voltage $V_{Ctrl}$ and outputs an error voltage signal EVS, wherein the control voltage $V_{Ctrl}$ is at a preset voltage level. More specifically, the linear modulation unit 70 includes an impedance matching unit 71 and an adder 72.

Figure 4:
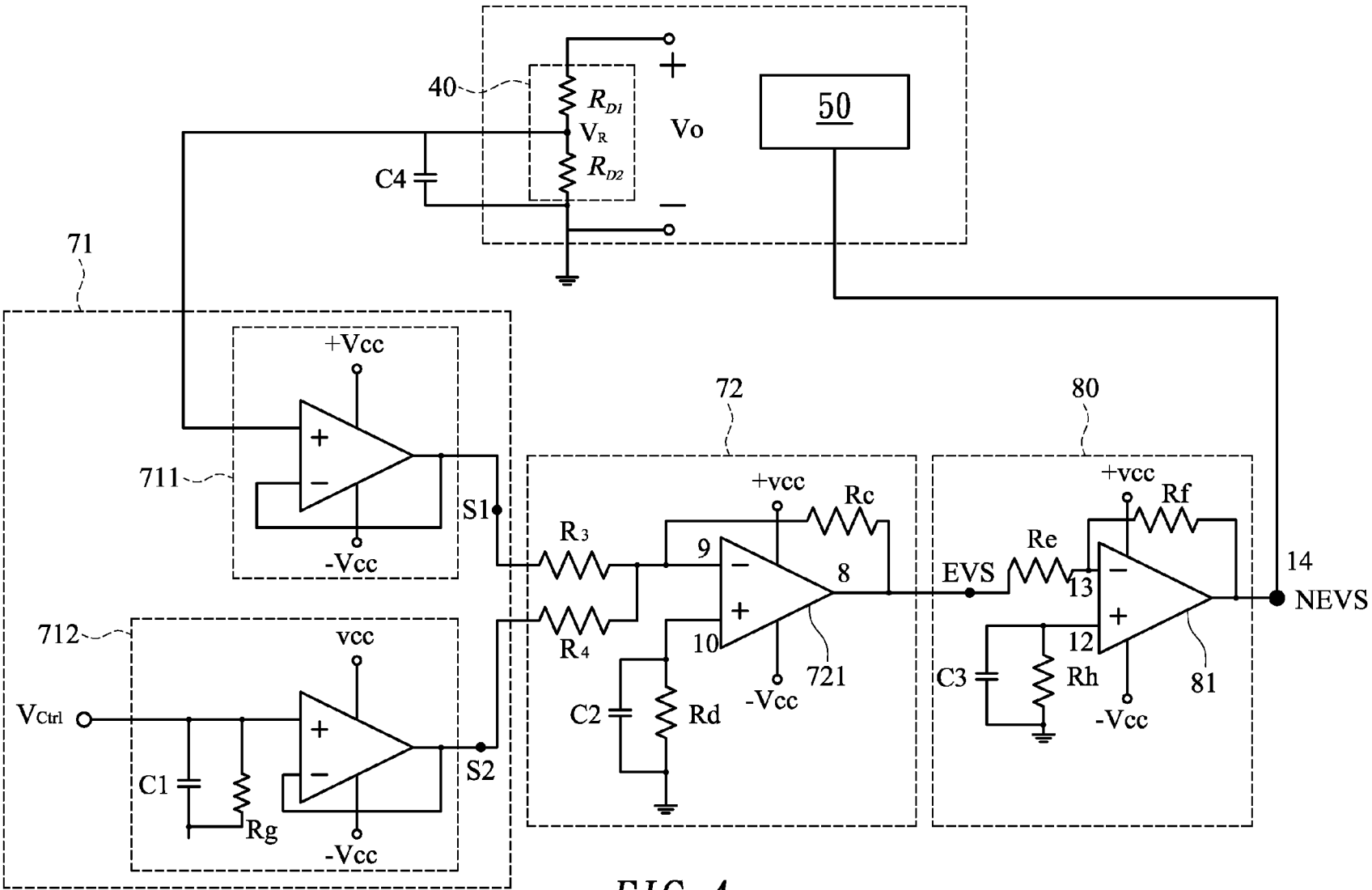
FIG. 4 is a circuit diagram of an embodiment of a linear modulation unit according to the present invention.

Referring also to FIG. 4, the impedance matching unit 71 serves mainly to receive the divided voltage $V_R$ output from the voltage division unit 40 and the control voltage $V_{Ctrl}$ and output a first signal $S_1$ and a second signal $S_2$. The impedance matching unit 71 includes a first emitter follower 711 and a second emitter follower 712, wherein the first emitter follower 711 is configured to receive the divided voltage $V_R$ and output the first signal $S_1$, and the second emitter follower 712 is configured to receive the control voltage $V_{Ctrl}$ and output the second signal $S_2$.

The adder 72 generates the error voltage signal EVS by summing the first signal $S_1$ and the second signal $S_2$. The adder 72 is composed of an operational amplifier 721, whose inverting positive input end is further connected with a third resistor $R_3$ and a fourth resistor $R_4$, thereby providing the aforesaid input end of the adder 72 with a voltage stabilizing and voltage following function.

Referring to FIG. 3, in order to adapt the phase of the error voltage signal EVS to the input signal phase of the error amplifier 50, an inverter 80 is provided between the linear modulation unit 70 and the error amplifier 50. As shown in FIG. 4, the inverter 80 is composed of an operational amplifier 81 and configured to receive the error voltage signal EVS and invert the phase thereof, thus generating a phase-inverted error voltage signal NEVS. Without the inverter 80, the error voltage signal EVS would be input directly to the error amplifier 50.

With reference to FIG. 3, the error amplifier 50 receives the phase-inverted error voltage signal NEVS and the divided voltage $V_R$. Under the phase-inverted error voltage signal NEVS which is a reference signal $V_{Ref}$ (i.e., a parameter for linear amplification of a voltage difference signal), the voltage difference between the phase-inverted error voltage signal NEVS and the divided voltage $V_R$ is adjusted, thereby generating an error gain control signal EGS. The error amplifier 50 includes an amplifier 53, a first impedance 51 connected between an input end and an output end of the amplifier 30, and a second impedance 52 connected to the aforesaid input end of the amplifier 53 so as to provide a voltage stabilizing and impedance matching function.

The recursive controller 60 receives the error gain control signal EGS and a check voltage $V_{Mag}$ and outputs a gain control signal GCS to the power stage unit 30 so as for the power stage unit 30 to modulate the first voltage $V_1$. The recursive controller 60 is a pulse width modulator 61, and the gain control signal GCS is a pulse width modulation signal. By modulating the pulse width of the error gain control signal EGS, the recursive controller 60 generates the gain control signal GCS that is suitable for being output to the power stage unit 30. The gain control signal GCS serves as a basis on which the power stage unit 30 determines whether to perform step-up, step-down, or step-up/down conversion on the first voltage $V_1$. The check voltage $V_{Mag}$ is a parameter needed in modulating the pulse width of the error gain control signal EGS.

The control principle is demonstrated by the following examples:

Case 1: When the control voltage $V_{Ctrl}$ is preset at 0, and a pre-arranged load circuit has a load voltage of 2.5V, the divided voltage $V_R$ output from the voltage division unit 40 is the reference voltage $V_{Ref}$ ($V_{Ref}=V_R$). As the load voltage increases, the reference voltage $V_{Ref}$ rises linearly with the load voltage ($V_{Ref}=V_R>2.5V$). Consequently, the error amplifier 50 transmits a voltage regulating signal to the recursive controller 60, forcing the divided voltage $V_R$ of the voltage division unit 40 to drop to a normal level ($V_{Ref}=V_R=2.5V$).

When the load voltage decreases, the reference voltage $V_{Ref}$ declines linearly with the load voltage. As a result, the error amplifier 50 transmits a voltage regulating signal to the recursive controller 60, and the divided voltage $V_R$ of the voltage division unit 40 is raised to the normal level ($V_{Ref}=V_R=2.5V$). Thus, the linear modulation voltage transformer circuitry 100 remains stable when the control voltage $V_{Ctrl}$ is 0.

Case 2: When the control voltage $V_{Ctrl}$ is preset at a positive level, it can be known from Case 1 that the divided voltage $V_R$ output from the voltage division unit 40 will follow the voltage of the load circuit and be linearly adjusted. Hence, the equation of $V_{Ref}=V_R\pm V_{Ctrl}$ is obtained, meaning that the reference voltage $V_{Ref}$ not only varies with the load voltage, but also has a voltage increment equal to the control voltage $V_{Ctrl}$ ($(V_{Ref}=2.5V\pm V_{Ctrl})>2.5V$). Once a voltage lowering signal is transmitted to the recursive controller 60, linear voltage reduction is carried out.

Case 3: When the control voltage $V_{Ctrl}$ is preset at a negative level, it can be known from Case 1 that the divided voltage $V_R$ output from the voltage division unit 40 will follow the load voltage and be linearly adjusted. Hence the equation of $V_{Ref}=V_R+(-V_{Ctrl})$ is obtained, meaning that the reference voltage $V_{Ref}$ not only varies with the load voltage, but also is lowered by a magnitude equal to the control voltage $V_{Ctrl}$ ($(V_{Ref}=2.5V+(-V_{Ctrl}))<2.5V$). Once a voltage raising signal is sent to the recursive controller 60, a linear voltage raising process begins.

Figure 5:
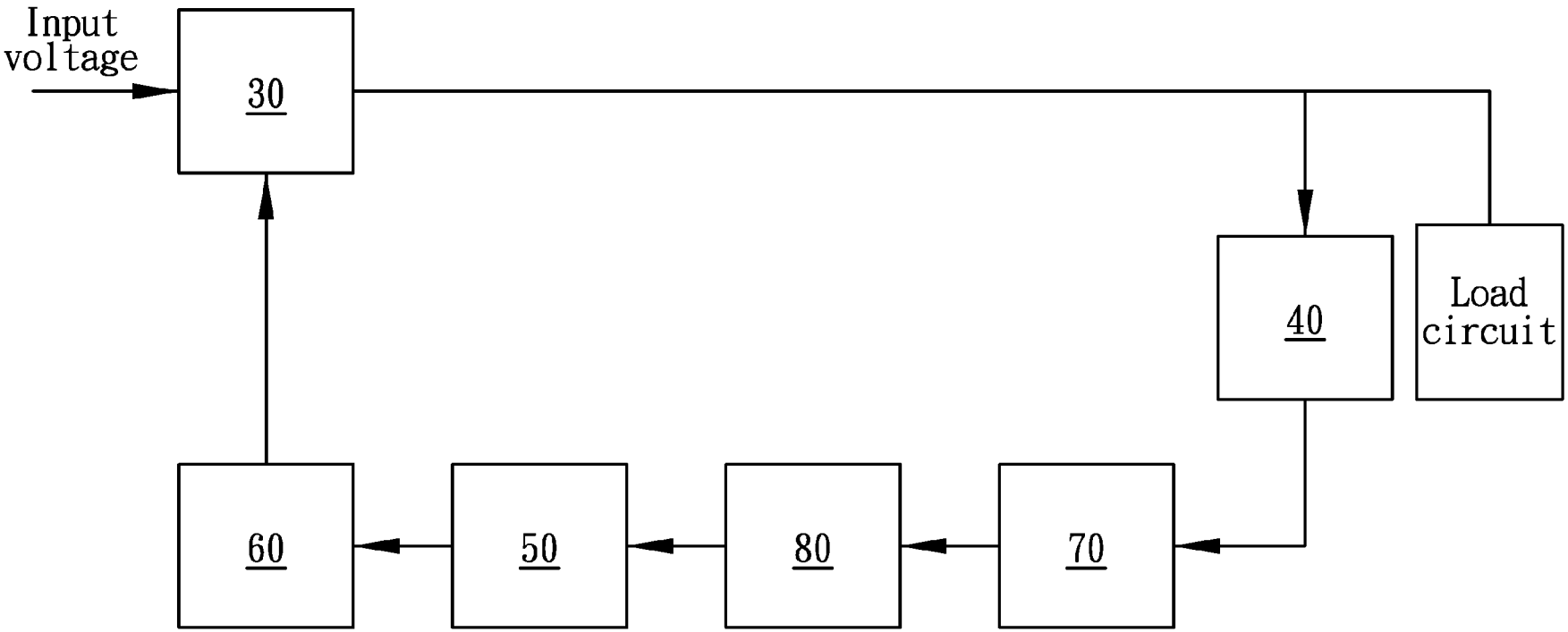
FIG. 5 is a block diagram of the linear modulation voltage transformer circuitry according to the present invention.

Referring to FIG. 5, the power stage unit 30, the voltage division unit 40, the linear modulation unit 70, the inverter 80, the error amplifier 50, and the recursive controller 60 form a closed-loop circuit that enables stable, continuous, and real-time feedback of parameters related to step-up, step-down, and step-up/down voltage conversion, so as to output specific voltages that meet specific load demands.

In contrast to the conventional voltage transformer, the linear modulation voltage transformer circuitry 100 exhibits excellent adaptability. In particular, the linear modulation unit 70 allows the linear modulation voltage transformer circuitry 100 to be used with load circuits of various voltage specifications without having to connect with additional voltage transformers. Furthermore, when the load circuit is changed, the linear modulation voltage transformer circuitry 100 can perform step-up, step-down, or step-up/down voltage conversion in real time to follow the voltage specification of the load circuit, without having to modify the circuitry 100 itself.

The embodiments described above serve to demonstrate the features of the present invention so that a person skilled in the art can understand the contents disclosed herein and implement the present invention accordingly. The embodiments, however, are not intended to limit the scope of the present invention, which is defined only by the appended claims. Therefore, all equivalent changes or modifications which do not depart from the spirit of the present invention should fall within the scope of the appended claims.

What is claimed is:

1. A linear modulation voltage transformer circuitry, comprising:

a power stage unit for receiving an input voltage, adapting the input voltage, and outputting a first voltage;

a voltage division unit electrically connected to an output end of the power stage unit and configured to receive the first voltage and output a divided voltage;

a linear modulation unit for receiving the divided voltage and a control voltage and outputting an error voltage signal;

an error amplifier for receiving the error voltage signal as a reference voltage, comparing the divided voltage with the reference voltage, and outputting an error gain control signal; and a recursive controller for receiving the error gain control signal and outputting a gain control signal to the power stage unit so as for the power stage unit to modulate the first voltage.

2. The linear modulation voltage transformer circuitry of claim 1, further comprising an inverter provided between the linear modulation unit and the error amplifier.

3. The linear modulation voltage transformer circuitry of claim 2, wherein the inverter is composed of an operational amplifier.

4. The linear modulation voltage transformer circuitry of claim 1, wherein the voltage division unit comprises a first resistor and a second resistor, which are connected in series between the output end of the power stage unit and a ground end, and a divided voltage output end for outputting the divided voltage is provided between the first resistor and the second resistor.

5. The linear modulation voltage transformer circuitry of claim 1, wherein the linear modulation unit comprises:

an impedance matching unit for receiving the divided voltage and the control voltage and outputting a first signal and a second signal; and an adder for receiving the first signal and the second signal and generating the error voltage signal.

6. The linear modulation voltage transformer circuitry of claim 5, wherein the impedance matching unit comprises:

a first emitter follower for receiving the divided voltage and outputting the first signal; and a second emitter follower for receiving the control voltage and outputting the second signal.

7. The linear modulation voltage transformer circuitry of claim 5, wherein the adder is composed of an operational amplifier.

8. The linear modulation voltage transformer circuitry of claim 1, wherein the recursive controller is a pulse width modulator and the gain control signal is a pulse width modulation signal.

* * * * *